US009368073B2

(12) United States Patent
Zhang et al.

(10) Patent No.: US 9,368,073 B2
(45) Date of Patent: Jun. 14, 2016

(54) LED BACKLIGHT DRIVING CIRCUIT AND LCD

(71) Applicant: Shenzhen China Star Optoelectronics Technology Co., Ltd., Shenzhen, Guangdong (CN)

(72) Inventors: Hua Zhang, Shenzhen (CN); Fei Li, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 157 days.

(21) Appl. No.: 14/112,545

(22) PCT Filed: Aug. 14, 2013

(86) PCT No.: PCT/CN2013/081425

§ 371 (c)(1),
(2) Date: Oct. 18, 2013

(87) PCT Pub. No.: WO2015/021607

PCT Pub. Date: Feb. 19, 2015

(65) Prior Publication Data

US 2015/0042233 A1 Feb. 12, 2015

(30) Foreign Application Priority Data

Aug. 12, 2013 (CN) ..... 2013 1 0349709

(51) Int. Cl.
*G09G 3/34* (2006.01)
*H05B 33/08* (2006.01)

(52) U.S. Cl.
CPC ..... *G09G 3/3426* (2013.01); *H05B 33/0815* (2013.01); *G09G 2330/02* (2013.01); *G09G 2330/06* (2013.01)

(58) Field of Classification Search
None
See application file for complete search history.

(56) References Cited

U.S. PATENT DOCUMENTS 5,905,369 A * 5/1999 Ishii ..... H02M 3/285 323/222
6,005,788 A * 12/1999 Lipo ..... H02M 7/49 363/71
7,373,527 B2 * 5/2008 Chapuis ..... H02J 1/102 307/29

(Continued)

FOREIGN PATENT DOCUMENTS

CN 1967988 A 5/2007
CN 102222471 A 10/2011
CN 103198809 A 7/2013

*Primary Examiner* — Alexander H Taningco
*Assistant Examiner* — Nelson Correa
(74) *Attorney, Agent, or Firm* — Andrew C. Cheng

(57) ABSTRACT

The present invention proposes an LED backlight driving circuit comprises voltage booster circuits parallelly connected and a constant current driving IC module. The voltage booster circuits are used for conversing an input voltage into a needed output voltage to supply to an LED unit. The constant current driving IC module is used for controlling the voltage booster circuits, so that the voltage booster circuits converse the input voltage into the needed output voltage to supply to the LED unit, driving the LED unit in a constant current. The constant current driving IC module generates driving signals at different frequencies to control the voltage booster circuits respectively. The invention can set up multiple driving signals operating simultaneously at different frequencies respectively and disperse resulting harmonic wave, hence reduce EMI signals of the backlight driving circuit effectively. The present invention also proposes an LCD using the LED backlight driving circuit.

8 Claims, 2 Drawing Sheets

(56) References Cited

U.S. PATENT DOCUMENTS 7,436,378 B2 * 10/2008 Ito et al. ..... 345/82
7,602,156 B2 * 10/2009 Weng ..... H02M 3/1584 323/222
8,053,923 B2 * 11/2011 Tateishi ..... H02M 3/07 307/10.8
8,344,653 B2 * 1/2013 Lee ..... H05B 33/0815 315/225
8,497,636 B2 * 7/2013 Nerone ..... H05B 33/0815 315/210
8,614,902 B2 * 12/2013 Pansier ..... H02M 1/4225 323/272
8,638,051 B2 * 1/2014 Kwon ..... 315/307
9,241,376 B2 * 1/2016 Zhang ..... G09G 3/3406
2007/0296887 A1 * 12/2007 Nakao ..... H05B 33/0815 349/62
2012/0127210 A1 * 5/2012 Huang ..... H05B 33/0815 345/690
2012/0256561 A1 10/2012 Kwon
2014/0320786 A1 * 10/2014 Zhang ..... 349/69

* cited by examiner

LED BACKLIGHT DRIVING CIRCUIT AND LCD

BACKGROUND OF THE INVENTION

1. Field of the Invention

The present invention relates to an LED backlight driving circuit, more particularly, to an LED backlight driving circuit capable of effectively decreasing signals of electromagnetic interference (EMI), and a liquid crystal display device thereof.

2. Description of the Prior Art

The backlight technique of a liquid crystal display (LCD) develops continuously along with development of relating art. A backlight source of the conventional LCD device applies cold cathode fluorescence lamp (CCFL). However, because of disadvantages such as low color restoration capability, low luminous efficiency, high discharge tension, low discharge property in low temperature and long duration of time for being heated to stable grayscale, a backlight source technique applying an LED backlight source has been exploited. In an LCD device, the LED backlight source and an LCD display panel are set up in opposition, so that the LED backlight source supplies a light source to the LCD display panel. The LED backlight source comprises at least a string of LEDs, and every string of LEDs comprises multiple LEDs.

FIG. 1 is a driving circuit of a conventional LED backlight source applied in the LCD device. As FIG. 1 indicates, the driving circuit of the LED backlight source comprises a voltage booster circuit 110, an LED unit 120 and a constant current driving integrated chip (IC) 130. The voltage booster circuit 110 is controlled by the constant current driving IC 130, so that input voltage is conversed to needed output voltage and hence supplied to the LED unit 120. The constant current driving IC 130 outputs a driving signal S to control on/off state of a MOS transistor Q in the voltage booster circuit 110. When the MOS transistor Q turns on, an input voltage Vin exerts on the two ends of an inductance L, causing linear increase of electric current through the inductance L. Due to the limit of electric current the inductance L can bear, however, the duration of time for which the MOS transistor Q turns on in a time cycle must be limited too. In addition, because the output voltage swing needed to light up the LED unit 120 decides the duty cycle of the driving signal S, the frequency of the driving signal S will be as high as between 100 kHz-200 kHz.

Electromagnetic Interference (EMI) means the interference due to interactions between electromagnetic waves and electronic components, comprising two types: conducted interference and radiated interference. Conducted interference means coupling (interfering) signals of one electric network to another electric network through conducted medium. Radiated interference means coupling (interfering) signals of interfering sources to another electric network through space. In a high-speed PCB and a system design, high-frequency signal lines, pins of integrated circuits, various types of socket connectors are all potential antenna characteristic interfering sources, capable of radiating electronic waves and interfering operations of other systems or other subsystems in the system.

In a large size LCD panel, a backlight source needs multiple strings of LEDs parallelly connected with each other. Because a single voltage booster circuit can only provides low electric current, multiple voltage booster circuits have to operate simultaneously in order to drive the backlight source. Conventionally, turns on and turns off of MOS transistors in multiple voltage booster circuits are both controlled by an identical driving signal from one constant current driving IC. Because of relatively high frequency of driving signals, the superposition of multiple high-speed driving signals of the same frequency will result in a relatively strong harmonic wave where frequency doubling exists, causing relatively strong EMI, which will severely interfere the LED driving circuit and the LCD device thereof.

SUMMARY OF THE INVENTION

It is therefore a primary object of the present invention to provide an LED backlight driving circuit to effectively reduce electromagnetic interference (EMI) signals.

According to the present invention, a light emitting diode (LED) backlight driving circuit, comprises:

a plurality of voltage booster circuits parallelly connected, for conversing an input voltage into a needed output voltage to supply to an LED unit, and a constant current driving integrated circuit (IC) module, for controlling the plurality of voltage booster circuits, so that the voltage booster circuits converse the input voltage into the needed output voltage to supply to the LED unit, driving the LED unit in a constant current;

wherein the constant current driving IC module generates driving signals at different frequencies to control the plurality of voltage booster circuits respectively.

Further, the constant current driving IC module comprises a plurality of constant current driving ICs, and each of the constant current driving ICs generates a driving signal at different frequency with that of other driving signals generated from the other constant current driving ICs, to control corresponding voltage booster circuits.

Further, the different frequencies of the driving signals are not integral multiples of each other.

Further, each voltage booster circuit comprises an inductance, metal-oxide-semiconductor (MOS) transistors, a diode, and a capacitor, wherein one end of the inductance receives an input direct current voltage, the other end of the inductance is connected to an anode of the diode, a cathode of the diode is connected to an anode of the LED unit, drains of the MOS transistors are connected to the anode of the diode, sources of the MOS transistors electrically ground, gates of the MOS transistors are connected to the constant current driving IC for receiving output driving signals from the constant current driving IC, one end of the capacitor is connected to the cathode of the diode, and the other end electrically grounds.

Further, the constant current driving IC is connected to a frequency control resistance, for controlling driving signals at different frequencies generated by the constant current driving IC.

Further, the constant current driving IC module comprises a constant current driving IC which generates a plurality of driving signals at different frequencies for controlling multiple voltage booster circuits.

Further, the frequencies of the different driving signals are not integral multiples of each other.

Further, the voltage booster circuit comprises an inductance, a MOS transistor, a diode and a capacitor, wherein one end of the inductance receives an input direct current voltage Vin, the other end of the inductance is connected to an anode of the diode, and a cathode of the diode is connected to an anode of an LED unit, a drain of the MOS transistor is connected to an anode of the diode, a source of the MOS transistor electrically grounds, a gate of the MOS transistor is connected to the constant current driving IC for receiving output driving signals from the constant current driving IC, one end of the capacitor is connected to the cathode of the diode, and the other end grounded.

Further, the LED unit is multiple strings of parallelly connected LEDs, and every string of the LEDs comprises a plurality of LEDs 121 in series, each string of the LEDs is grounded through one resistance, a cathode of every string of the LEDs is connected to the resistance, and the other end of the resistance is grounded.

According to the present invention, a liquid crystal display (LCD) comprises an LED backlight source using a light emitting diode (LED) backlight driving circuit as mentioned above.

The invention can set up multiple driving signals operating simultaneously at different frequencies respectively and disperse resulting harmonic wave, hence reduce EMI signals of the backlight driving circuit effectively.

DETAILED DESCRIPTION OF THE PREFERRED EMBODIMENTS

As previously mentioned, the object of the present invention is to provide an LED backlight driving circuit to effectively reduce electromagnetic interference (EMI) signals. The LED backlight driving circuit comprises a plurality of voltage booster circuits parallelly connected and a constant current driving integrated circuit (IC) module. The voltage booster circuits are used for conversing an input voltage into a needed output voltage to supply to an LED unit. The constant current driving integrated circuit (IC) module is used for controlling the plurality of voltage booster circuits, so that the voltage booster circuits converse the input voltage into the needed output voltage to supply to the LED unit, driving the LED unit in a constant current. The constant current driving IC module generates driving signals at different frequencies to control the plurality of voltage booster circuits respectively. The invention can set up multiple driving signals operating simultaneously at different frequencies respectively and disperse resulting harmonic wave, hence reduce EMI signals of the backlight driving circuit effectively.

The present invention is described in detail in conjunction with the accompanying drawings and embodiments.

Embodiment 1

Figure 1:
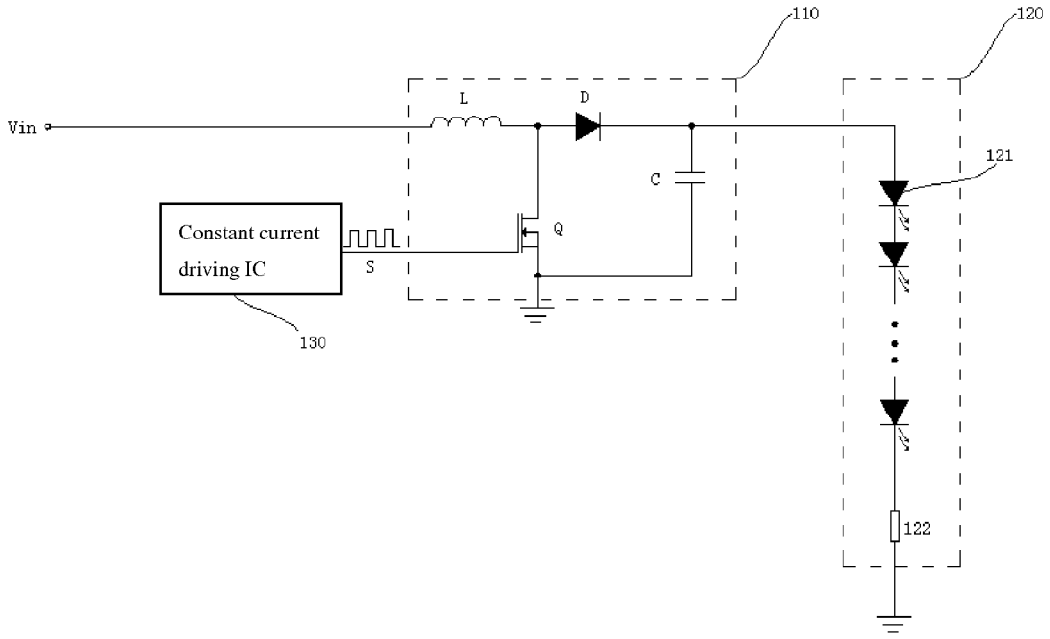
Fig. 1 (Prior Art)
FIG. 1 is a driving circuit of a conventional LED backlight source applied in the LCD device.
Figure 2:
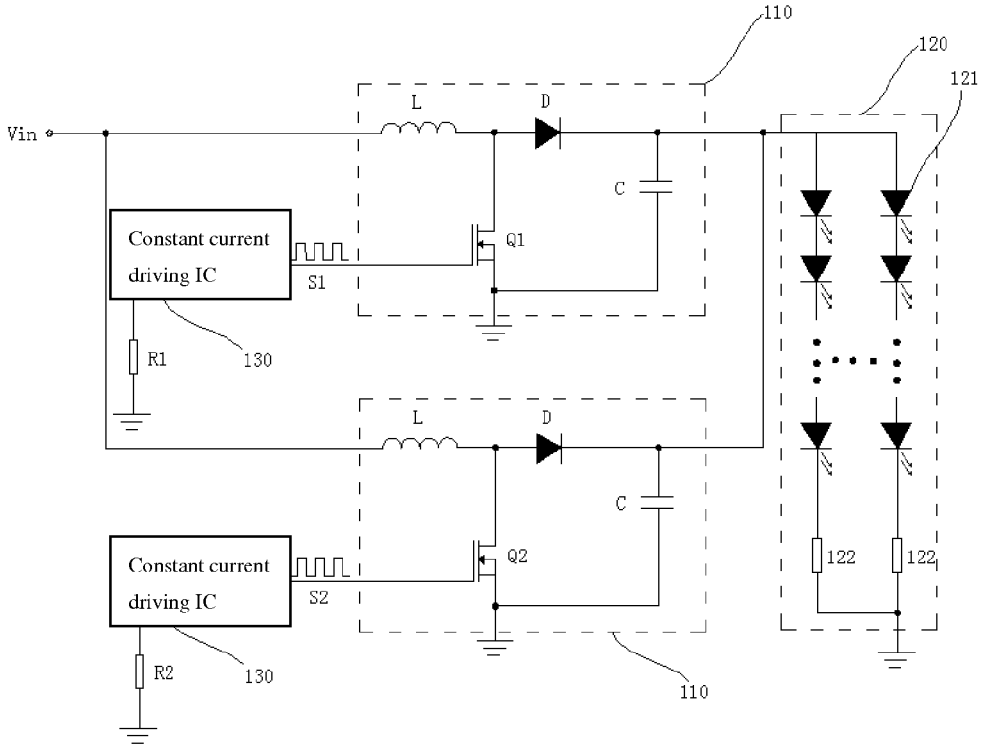
FIG. 2 is a circuit of an LED backlight driving circuit according to a first embodiment of the present invention.

FIG. 2 is a circuit of an LED backlight driving circuit according to a first embodiment of the present invention.

In the embodiment, the LED backlight driving circuit comprising two voltage booster circuits exemplifies the invention. As FIG. 2 indicates, the LED backlight driving circuit comprises two voltage booster circuits 110 parallelly connected and two constant current driving ICs 130. The constant current driving IC 130 controls the voltage booster circuit 110, so that the voltage booster circuit 110 can convert an input voltage Vin into a needed output voltage to supply an LED unit 120 and achieve constant current driving the LED unit 120.

The voltage booster circuit 110 comprises an inductance L, a diode D, a metal-oxide-semiconductor (MOS) transistor Q1 or Q2 and a capacitor C. One end of the inductance L receives an input direct current voltage Vin, the other end of the inductance L is connected to the anode of the diode D, and the cathode of the diode D is connected to the anode of the LED unit 120. Drains of the MOS transistors Q1 and Q2 are connected to the anodes of the diodes D, sources of the MOS transistors Q1 and Q2 are electrically connected to ground. Gates of the MOS transistors Q1 and Q2 are respectively connected to the constant current driving ICs 130, receiving output driving signals S1 and S2 from the constant current driving ICs 130, correspondingly. One end of the capacitor C is connected to the cathode of the diode D, the other end is electrically connected to ground.

In the embodiment, the constant current driving IC 130 is also connected to frequency control resistances R1 and R2, which control driving signals at different frequencies generated by the constant current driving IC 130.

The frequency control resistances R1 and R2 can be variable resistors.

In the embodiment, the frequency control resistance R1 is adjusted to have the first constant current driving IC generate a driving signal S1, which controls turns on or turns off of the MOS transistor Q1 in the first voltage booster circuit. The frequency control resistance R2 is adjusted to have the second constant current driving IC generate a driving signal S2, which controls turns on or turns off of the MOS transistor Q2 in the second voltage booster circuit. The driving signals S1 and S2 are unequal. In the embodiment, two voltage booster circuits 110 are controlled by two constant current driving ICs 130 and therefore operate under different frequencies of driving signals, hence the EMI of the backlight driving circuit is effectively reduced.

In the embodiment, the frequencies of the driving signals S1 and S2 are not integral multiples of each other.

In the embodiment, the LED unit 120 is multiple strings of parallelly connected LEDs, and every string of LED comprises multiple LEDs 121 in series. Every string of LED electrically is electrically connected to ground through a resistance 122, i.e. the cathode of every string of LED is connected to the resistance 122, and the other end of the resistance 122 is electrically connected to ground.

Embodiment 2

Figure 3:
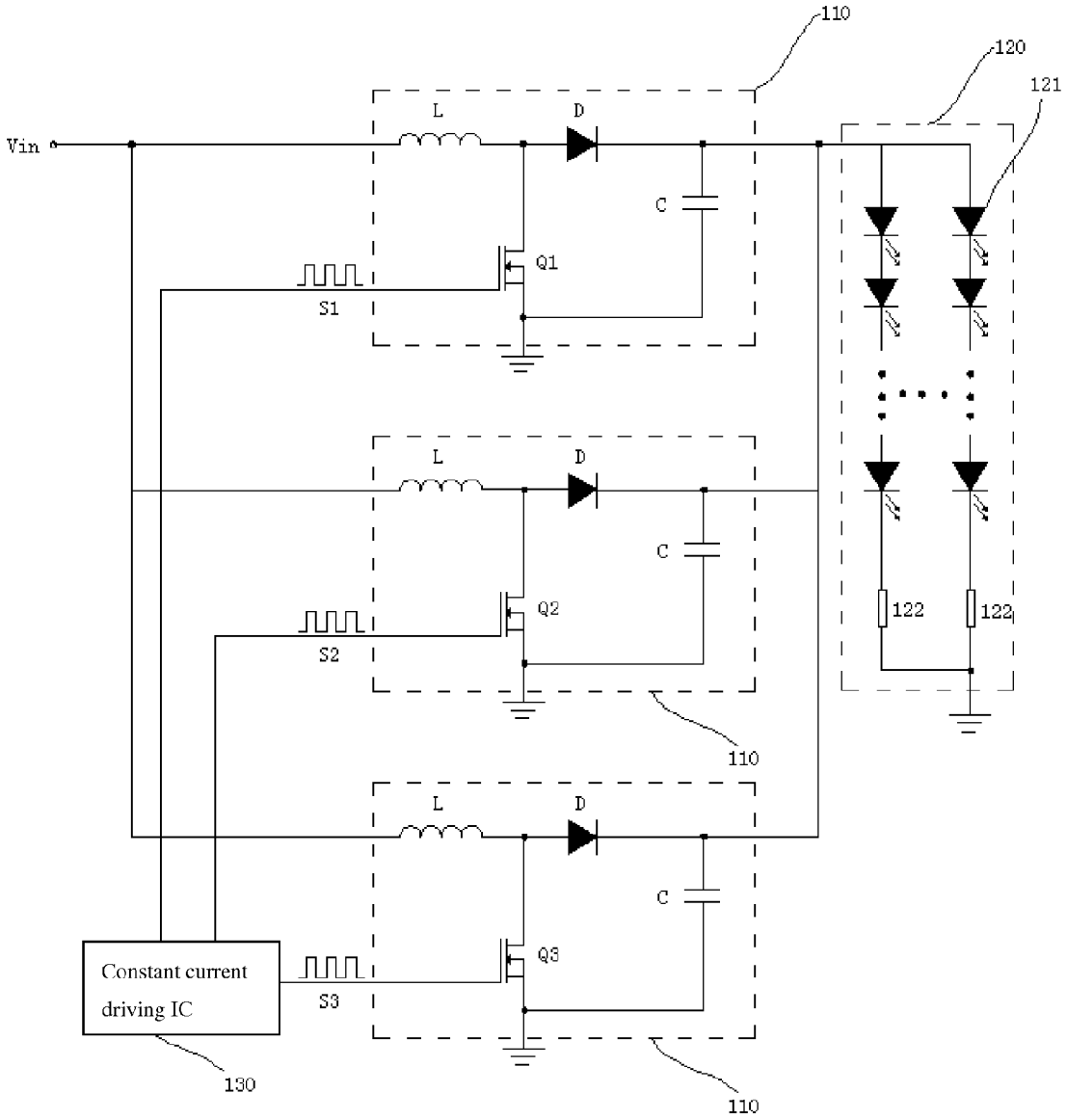
FIG. 3 is a circuit of an LED backlight driving circuit according to a second embodiment of the present invention.

FIG. 3 is a circuit of an LED backlight driving circuit according to a second embodiment of the present invention.

In the embodiment, the LED backlight driving circuit comprising three voltage booster circuits exemplifies the invention. As FIG. 3 indicates, the LED backlight driving circuit comprises three voltage booster circuits 110 parallelly connected and one constant current driving IC 130. The constant current driving IC 130 controls the voltage booster circuits 110, so that the voltage booster circuits 110 can convert an input voltage Vin into a needed output voltage to supply an LED unit 120, and achieve constant current driving the LED unit 120.

The voltage booster circuit 110 comprises an inductance L, a diode D, a MOS transistor Q1 or Q2 or Q3 and a capacitor C. One end of the inductance L receives an input direct current voltage Vin, the other end of the inductance L is connected to the anode of the diode D, and the cathode of the diode D is connected to the anode of the LED unit 120. Drains of the MOS transistors Ql, Q2 and Q3 are connected to the anodes of the diodes D, sources of the MOS transistors Ql, Q2 and Q3 are grounded. Gates of the MOS transistors Ql, Q2 and Q3 are connected to the constant current driving IC 130, receiving output driving signals Sl, S2 and S3 from the constant current driving IC 130. One end of the capacitor C is connected to the cathode of the diode D, the other end is grounded.

In the embodiment, the constant current driving IC 130 can generate driving signals S1, S2 and S3 with different frequencies. The driving signal S1 controls turns on or turns off of the MOS transistor Q1 in the first voltage booster circuit, the driving signal S2 controls turns on or turns off of the MOS transistor Q2 in the second voltage booster circuit, and the driving signal S3 controls turns on or turns off of the MOS transistor Q3 in the third voltage booster circuit. The driving signals S1, S2 and S3 are unequal. In the embodiment, different voltage booster circuits are controlled by different driving signals with different frequencies generated from one constant current driving IC and therefore operate under different frequencies of driving signals, hence the EMI of the backlight driving circuit is effectively reduced.

In the embodiment, the frequencies of the driving signals S1, S2 and S3 are not integral multiples of each other.

In the embodiment, the LED unit 120 is multiple strings of parallelly connected LEDs, and every string of LEDs comprises multiple LEDs 121 in series. Every string of LEDs are grounded through the resistance 122, i.e. the cathode of every string of LED is connected to the resistance 122, and the other end of the resistance 122 is grounded.

The number of voltage booster circuits parallelly connected illustrated above just serves as an example. It sets no limit to the technical scheme of the invention. The number of voltage booster circuits parallelly connected can be adjusted according to the number of LED strings in LED units.

In sum, the invention can set up multiple driving signals simultaneously operating at different frequencies respectively, and disperse resulting harmonic wave, hence reduce EMI signals of the backlight driving circuit effectively.

The terms "a" or "an", as used herein, are defined as one or more than one. The term "another", as used herein, is defined as at least a second or more. The terms "including" and/or "having" as used herein, are defined as comprising (i.e. open transition). The term "coupled" or "operatively coupled" as used herein, is defined as connected, although not necessarily directly, and not necessarily mechanically.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light emitting diode (LED) backlight driving circuit, comprising:

a plurality of voltage booster circuits parallelly connected, for converting an input voltage into a needed output voltage to supply to an LED unit, and a plurality of constant current driving integrated circuit (IC), for controlling the plurality of voltage booster circuits, so that the voltage booster circuits convert the input voltage into the needed output voltage to supply to the LED unit, driving the LED unit in a constant current;

wherein the plurality of constant current driving IC generates driving signals at different frequencies to control the plurality of voltage booster circuits respectively, wherein each of the constant current driving ICs generates a driving signal at a different frequency from those of other driving signals generated from the other constant current driving ICs, to control corresponding voltage booster circuits, wherein each of the constant current driving ICs is connected to a frequency control resistance, for controlling the driving signals at the different frequencies generated by the constant current driving ICs, and the frequency control resistances are variable resistors.

2. The LED backlight driving circuit according to claim 1, wherein the different frequencies of the driving signals are not integral multiples of each other.

3. The LED backlight driving circuit according to claim 1, wherein each of the voltage booster circuits comprises an inductance, a metal-oxide-semiconductor (MOS) transistor, a diode, and a capacitor, wherein one end of the inductance receives an input direct current voltage, the other end of the inductance is connected to an anode of the diode, a cathode of the diode is connected to an anode of the LED unit, a drain of the MOS transistor is connected to the anode of the diode, a source of the MOS transistor electrically grounds, a gate of the MOS transistors is connected to one of the constant current driving ICs correspondingly for receiving one of output driving signals from the corresponding constant current driving IC, one end of the capacitor is connected to the cathode of the diode, and the other end electrically grounds.

4. The LED backlight driving circuit according to claim 1, wherein the LED unit is multiple strings of parallelly connected LEDs, and every string of the LEDs comprises a plurality of LEDs in series, each string of the LEDs is grounded through one resistance, a cathode of every string of the LEDs is connected to the resistance, and the other end of the resistance is grounded.

5. A liquid crystal display (LCD), comprising a light emitting diode (LED) backlight source, the LED backlight source comprising a LED backlight driving circuit, the LED backlight driving circuit comprising:

a plurality of voltage booster circuits parallelly connected, for converting an input voltage into a needed output voltage to supply to an LED unit, and a plurality of constant current driving ICs, for controlling the plurality of voltage booster circuits, so that the voltage booster circuits convert the input voltage into the needed output voltage to supply to the LED unit, driving the LED unit in a constant current;

wherein the plurality of constant current driving ICs generates driving signals at different frequencies to control the plurality of voltage booster circuits respectively, wherein each of the constant current driving ICs generates a driving signal at a different frequency from those of other driving signals generated from the other constant current driving ICs, to control corresponding voltage booster circuits, wherein each of the constant current driving ICs is connected to a frequency control resistance, for controlling the driving signals at the different frequencies generated by the constant current driving ICs, and the frequency control resistances are variable resistors.

6. The liquid crystal display according to claim 5, wherein the different frequencies of the driving signals are not integral multiples of each other.

7. The liquid crystal display according to claim 5, wherein each of the voltage booster circuits comprises an inductance, a MOS transistor, a diode, and a capacitor, wherein one end of the inductance receives an input direct current voltage, the other end of the inductance is connected to an anode of the diode, a cathode of the diode is connected to an anode of the LED unit, a drain of the MOS transistors is connected to the anode of the diode, a source of the MOS transistor electrically grounds, a gate of the MOS transistor is connected to one of the constant current driving ICs correspondingly for receiving one of output driving signals from the correspondingly constant current driving IC, one end of the capacitor is connected to the cathode of the diode, and the other end electrically grounds.

8. The liquid crystal display according to claim 5, wherein the LED unit is multiple strings of parallelly connected LEDs, and every string of the LEDs comprises a plurality of LEDs in series, each string of the LEDs is grounded through one resistance, a cathode of every string of the LEDs is connected to the resistance, and the other end of the resistance is grounded.

* * * * *